US007128225B2

(12) United States Patent
Saltzburg et al.

(10) Patent No.: US 7,128,225 B2
(45) Date of Patent: Oct. 31, 2006

(54) CARGO RACK

(75) Inventors: Bruce Saltzburg, Northbrook, IL (US); David Wojtowicz, Orland Park, IL (US); Jeffery L. Lamber, Richton Park, IL (US); Thomas J. St. Germain, Bridgeview, IL (US); Anthony J. Troyner, Shorewood, IL (US); Mitchell E. Bianchin, Villa Park, IL (US)

(73) Assignee: Edsal Manufacturing Co., Inc., Chicago, IL (US)

( * ) Notice: Subject to any disclaimer, the term of this patent is extended or adjusted under 35 U.S.C. 154(b) by 206 days.

(21) Appl. No.: 10/715,000

(22) Filed: Nov. 17, 2003

(65) Prior Publication Data

US 2005/0103733 A1 May 19, 2005

(51) Int. Cl.
*A47B 47/00* (2006.01)

(52) U.S. Cl. ..... 211/187

(58) Field of Classification Search ..... 211/187, 211/186, 191, 192, 193, 208
See application file for complete search history.

(56) References Cited

U.S. PATENT DOCUMENTS 3,278,043 A * 10/1966 Kimpton ..... 211/191
4,106,630 A * 8/1978 Rosenband ..... 211/191
5,553,549 A 9/1996 Nilsson
5,749,481 A 5/1998 Miller
5,769,249 A * 6/1998 Lascara ..... 211/191
5,908,119 A * 6/1999 Kump et al. ..... 211/113
6,196,401 B1 * 3/2001 Brady et al. ..... 211/186
6,378,711 B1 * 4/2002 Skulnik et al. ..... 211/183

OTHER PUBLICATIONS

Standard MR-185 Rack designed by Edsal Manufacturing Co., Inc., as seen in attached documents.
Standard MR-245 Rack designed by Edsal Manufacturing Co., Inc., as seen in attached documents.
Also Refer to p. 9 of Catalog "Home-E-Quip" Consumer Products Div.-Edsal Mfg Co.

* cited by examiner

*Primary Examiner*—Sarah Purol

(57) ABSTRACT

A cargo rack utilizing a structural beam in the form of three embodiments, two of the embodiments comprising a rib, one of which includes a recessed flange and a horizontal return flange, the other includes a standard angled flange and an angled return flange, the third embodiment includes a recessed flange and a horizontal return flange, structural beams used in a framework comprising a plurality of vertical posts containing key shaped apertures and a plurality of horizontal shelving members, structural beams contain nubs enabling structural beams to connect to vertical posts via key shaped apertures thereby enabling horizontal shelving members to be associated with structural beams and vertical posts, various attachments may be added to cargo rack when recessed structural beams are used via a slight clearance that is formed between the recessed edge and a slight taper on horizontal shelving member sides.

25 Claims, 2 Drawing Sheets

CARGO RACK

BACKGROUND OF THE INVENTION

This invention relates in general to a shelving unit and more particularly to the structural beams in the shelving unit. Several products are similar to this product in that they rely on beams affixed to posts to form a rigid shell that in turn supports shelf members. Examples of such prior art are illustrated in the following U.S. Pat. Nos. 5,553,549 and 5,749,481.

Similar frameworks are typically provided with four vertical corner posts and a plurality of horizontal members. For example, U.S. Pat. No. 5,553,549 issued to Nilsson discloses a framework for a shelving unit comprising horizontal members, a plurality of vertical posts, and a locking attachment for connecting the horizontal members to the vertical posts. One disadvantage of this prior art design is that the horizontal support members do not provide enough load bearing capabilities. A further result of this is a poor utilization of material. The material gauge or thickness is higher than necessary and the strength to material weight ratio could be improved which may result in a lower cost per unit of capacity.

U.S. Pat. No. 5,749,481 issued to Miller utilizes a storage rack and a structural beam to maximize the strength of the beam construction. However, the storage rack and structural beam of this patent are very large. Its size assumes a consumer will have an excess of space to house the rack. The storage rack utilizes a structural member to ensure that decking members and pallets will be adequately supported. While the rack has greater strength capabilities, it is very large in size and in weight. The structural beams are connected to the support columns or posts by removeable attachment pins. Specifically, each beam is provided with an upright connector plate with holes for receiving a pin which is then inserted through a selected hole in the vertical column or post. Another disadvantage of this prior art design is that there are a multiplicity of components required for assembly including the aforementioned pins as well as pliers or screwdrivers. Furthermore, it is possible for the nuts and bolts to become loosened over time, thereby resulting in potential instability of the shelving assembly.

Previous structural beams have been used in similar shelving units. An example is a beam model that had a profile of an "L" shape. The beam simply had a flange that came off perpendicular to the top of the beam. Although there are other differences between this prior art and the present invention such as the shape of apertures on the vertical posts, the crux of this prior art is the cross section of the beam profile. The shelving unit containing this beam is an adequate shelving unit. However, this beam does not have a large load bearing capacity. The overall strength and capacity may be substantially improved. Namely, it is possible to provide greater rigidity against horizontal deflection of the beam and maintain the depth of the unit by providing additional rigidity against deflection.

BRIEF SUMMARY OF THE INVENTION

These and other problems and disadvantages associated with the prior art are overcome by the invention disclosed herein by providing a structural beam in the form of three embodiments for a storage unit that minimizes cost per unit, maximizes strength to material weight ratio, is easily assembled, and ensures that cargo will be adequately and better supported.

The invention is directed to the structural beams and to the shelving unit embodying the structural beams. The structural beams are produced in three styles. Two of the styles allow the shelf member to be mounted in a recessed position on the beam while the other style allows the shelf member to be mounted on top of the beam thereby being completely exposed. One recessed structural beam contains a return flange at its base, a recessed flange at its top, and a rib formed there between. The second recessed structural beam is a slight variation of the first in that it does not include a rib; however, it contains a return flange at its base and a recessed flange at its top. The standard structural beam contains an angled return flange at its base, a standard angled flange at its top, and a rib there between.

The cross section and profile of each of the beams in the framework results in greater rigidity and column strength. The cross-section of the beams' profiles improves the strength by "stiffening" the beam, and reducing the amount of deflection under loading. This allows a stronger unit at greater load bearing capacities with less material. The beams offer a combination of strength and ruggedness and a unique appearance.

The primary purpose of the rib, as used with both recessed and standard beams, is to provide rigidity against horizontal deflection. However, it also maintains the depth of the unit and provides additional rigidity against deflection in this axis. Furthermore, the return flanges of all three beams provide rigidity against horizontal axis deflection. The return flanges also maintain the depth of the unit and provide additional rigidity against deflection in this axis.

The standard angled flange on the standard structural beam adds rigidity to the beam and supports the shelving member from its bottom. The concept for a slight angle in the flange was designed and based on the flexibility of particle board used as shelving. As a load is applied, the board will begin to flex. The gap created by the form will begin to close and, as the load is progressively applied, will establish complete surface contact. Therefore, the unit gathers additional support as the load becomes heavier all the way up to the complete surface contact.

Furthermore, the angled return flange as used in the standard beam comes into effect as weight is applied and deflection begins. As indicated in the drawing, the part itself begins to bend or flex outward. As the applied load increases, the angled return flange provides additional resistance against this movement.

The recessed flange; however, provides support to the shelving member from the sides as well as the bottom. In doing so, the recessed flange maintains the integrity of a single piece of steel. There is no need for a completely separate part to trap the sides of the particle board, provide support from the bottom, and establish a double thickness of material. The strip width of the steel is established to accommodate a 180 degree return bend and 90 degree flange. The 180 degree return bend has a double thickness that also adds rigidity to the edge of the material. This not only distributes static and dynamic loads, but also contributes additional overall strength and capacity. The recessed flange is designed such that once the framework on the unit is assembled, the shelving member will drop into the frame and rest inside the beams and braces.

The shelving unit of the present invention preferably includes at least 4 vertical post members mutually spaced from one another. The structural beams are orientated perpendicular to post members and removeably associated therewith taking the form of a parallelogram. The shelving unit is complete when shelf members are removeably attached to the structural beam and vertical post framework. Various attachments may be added to the shelving unit when the recessed structural beams are used. These and other features will become more clearly understood upon consideration of the following detailed description and accompanying drawings.

DETAILED DESCRIPTION OF THE PREFERRED EMBODIMENTS

Figure 1:
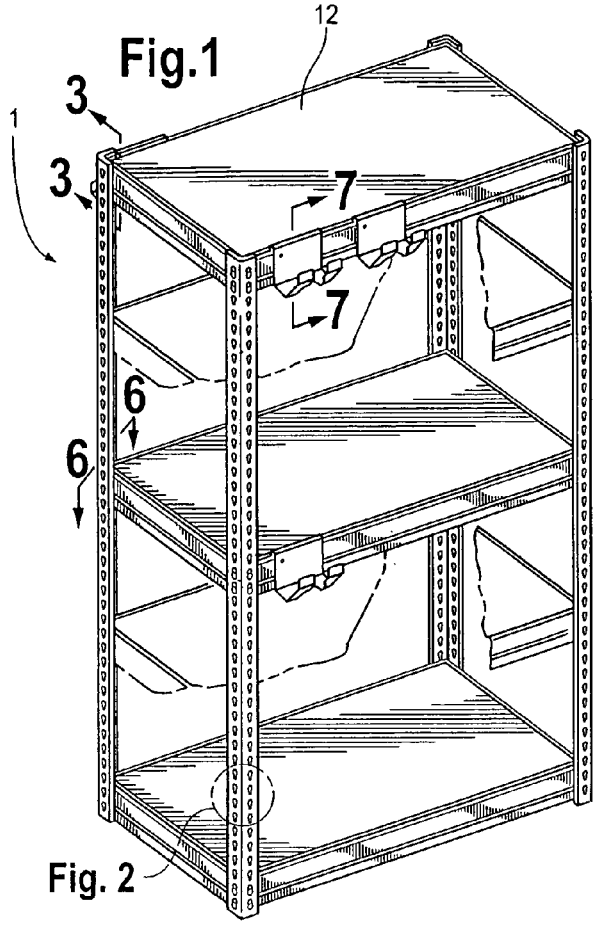
FIG. 1 is an isometric view of the shelving unit.
Figure 4:
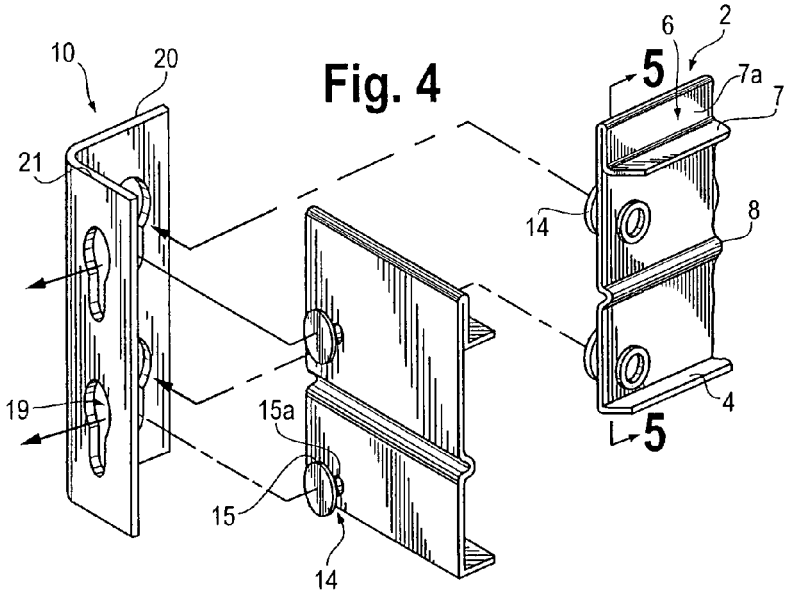
FIG. 4 is an exploded view illustrating the recessed structural beam with ribbing to vertical post assembly via nubs and apertures.

Referring to FIG. 1, the assembled shelving unit 1 is shown including four vertical posts 10. Each vertical post 10 has a pair of legs 20, 21 perpendicular to one another as shown in FIG. 4. A plurality of structural beams 2, 25, or 30 and horizontal shelving members 12 extend between the pairs of legs 20, 21 on vertical posts 10 and are attached in a manner to be described below.

Figure 5:
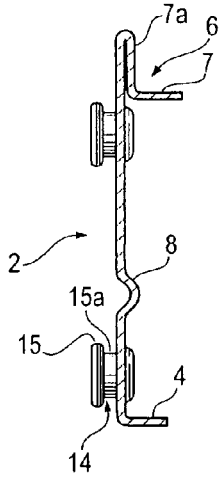
FIG. 5 is a cross sectional view of the profile of the recessed structural beam with ribbing.

The recessed structural beams 2 include a rib 8, with a recessed flange 6, and a return flange 4 as seen in FIG. 5. The rib 8, recessed flange 6, and return flange 4 terminate in a vertical edge of the recessed structural beam 2. The recessed flange 6 is chamfered at the ends of its base 7 in order to enable assembly to appear as seen in FIG. 4 once it has moved along the dashed lines to engage the legs 20, 21 of the vertical post 10.

The recessed structural beam 2 is preferably and approximately 2.5 inches in height. The recessed flange 6 is preferably and approximately 0.56 inches in height and 0.47 inches in length. The center point of the rib 8 is preferably and approximately located 0.88 inches from the base of the recessed structural beam 2. The rib 8 is roughly 0.338 inches in height with radiuses at its ends of about 0.095 inches while its center radius is at approximately 0.11 inches. The horizontal return flange 4 is approximately 0.22 inches in length. The location and/or dimensions are critical to the overall capacity of the product. However, the major features are the characteristics of the shape of these attributes. The specific locations do not materially affect the overall capacity. While the above listed dimensions are preferred, other combinations are possible.

Figure 13:
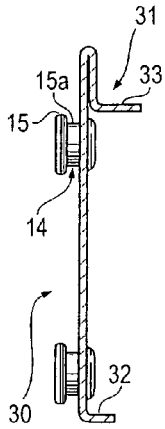
FIG. 13 is a cross sectional profile of the recessed structural beam without ribbing.

The recessed structural beams 30 combine a recessed flange 31 and a return flange 32 as seen in FIG. 13. The recessed flange 31 and return flange 32 terminate in a vertical edge of the recessed structural beam 30. The recessed flange 31 is chamfered at its base 33 in order to enable assembly much in the same way as recessed flange 6 is chamfered at its base 7 on recessed structural beams 2 as shown in FIG. 4 once it has moved along the dashed lines to engage the legs 20, 21 of the vertical post 10.

The recessed structural beam 30 is preferably and approximately 2.8 inches in height. The recessed flange 31 is preferably and approximately 0.566 inches in height and 0.47 inches in length. The horizontal return flange 32 is preferably and approximately 0.22 inches in length. The location and/or dimensions are critical to the overall capacity of the product. However, the major features are the characteristics of the shape of these attributes. The specific locations do not materially affect the overall capacity. While the above listed dimensions are preferred, other combinations are possible.

Figure 11:
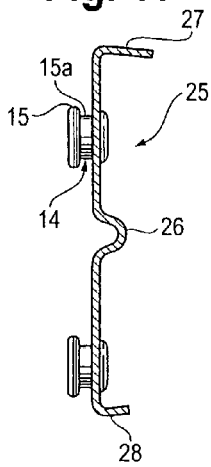
FIG. 11 is a cross sectional view taken along a plane passing through the line 11/11 and looking in the direction of the arrows of the line 11/11 of the standard structural beam.
Figure 10:
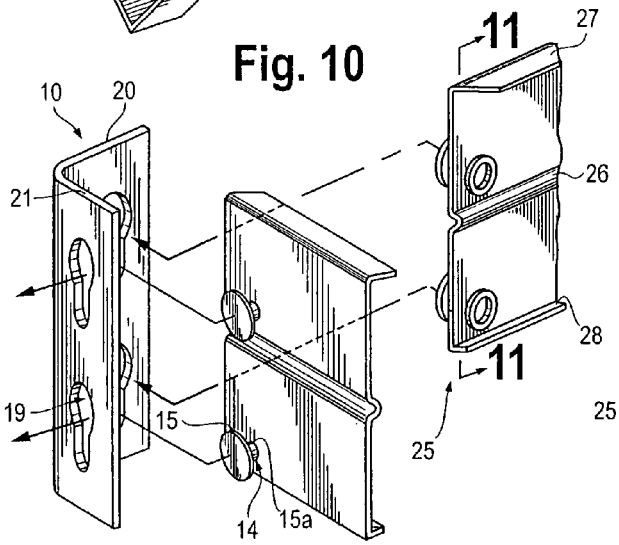
FIG. 10 is an exploded view illustrating a standard structural beam with ribbing being assembled to vertical post via nubs and apertures.

The standard structural beams 25 includes a rib 26 formed between an angled standard flange 27 and an angled return flange 28 as seen in FIG. 11. The rib 26, angled standard flange 27, and angled return flange 28 terminate in a vertical edge of the standard structural beam 25. The angled standard flange 27 is chamfered in order to enable standard structural beam assembly to appear as seen in FIG. 10 once it has moved along the dashed lines to engage the legs 20, 21 of vertical post 10.

The standard structural beam 25 is preferably and approximately 2.25 inches in height. The angled standard flange 27 is preferably and approximately 0.385 inches in length forming an acute angle of approximately 85 degrees with the vertical portion of the beam 25. The rib 26 is preferably and approximately 0.338 inches in height with radiuses at its ends of about 0.095 inches while its center radius is at approximately 0.11 inches. The angled return flange 28 is approximately 0.23 inches in length forming an acute angle of approximately 85 degrees with the vertical portion of the beam 25. The location and/or dimensions are critical to the overall capacity of the product. However, the major features are the characteristics of the shape of these attributes. The specific locations do not materially affect the overall capacity. The above listed dimensions are preferred, but other combinations are possible.

Figure 6:
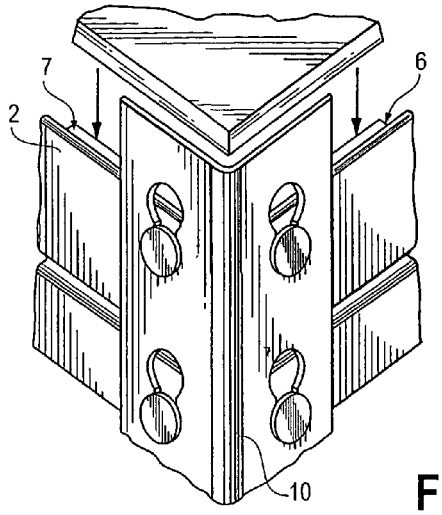
FIG. 6 is a corner view illustrating a shelf member being installed and positioned by the recessed flange.
Figure 7:
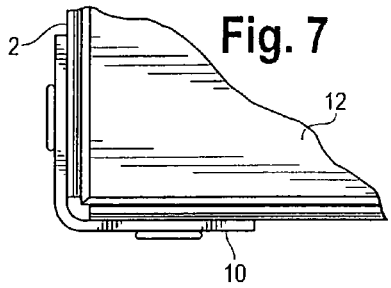
FIG. 7 is a broken top view of the corner of the shelving unit.
Figure 12:
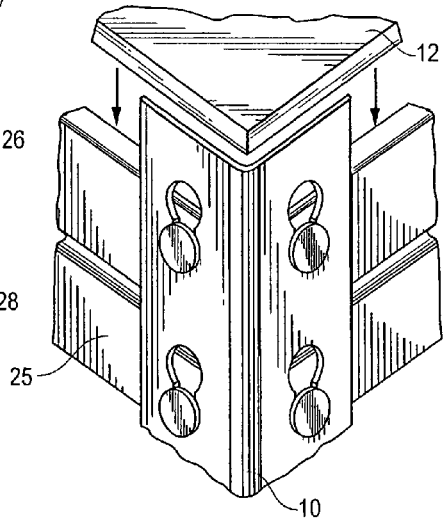
FIG. 12 is a corner view illustrating a shelf member being installed and positioned by the standard beam with ribbing and the angled flange.

Structural beams 2, 25, and 30 are provided with nubs 14 which are welded to said structural beams 2, 25, and 30 which can be seen in FIG. 5, FIG. 11 and FIG. 13 respectfully. The purpose of nubs 14 is to enable structural beams 2, 25, and 30 to be associated with the vertical post 10. A pair of nubs 14 are located at each end of structural beams 2, 25, and 30. The vertical location of each pair of nubs 14 must be relative to the vertical distance between the key shaped apertures 18 on legs 20 and 21 on vertical post 10. The horizontal location of nubs 14 on structural beams 2, 25, and 30 must be such that they would enable a corner fit between structural beams 2, 25, or 30 such as shown in FIG. 6 and FIG. 12. As such, each pair of nubs 14 will be proportionate across the vertical centerline of structural beams 2, 25, and 30.

Figure 2:
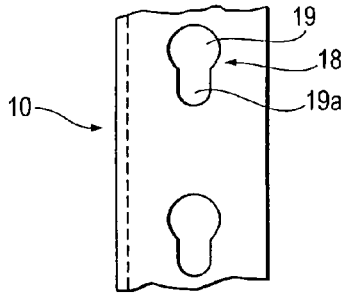
FIG. 2 is a broken view of the apertures on a vertical post.

As seen in FIG. 1 and FIG. 2, the vertical posts 10 are provided with a plurality of key shaped apertures 18 each generally comprising a circular hole 19 with a slot 19*a* that extends slightly downward from the larger circular hole 19. These key shaped apertures 18 along with nubs 14 enable beams 2, 25, and 30 to be assembled to the vertical post 10.

To assemble the framework, the vertical posts 10 should be orientated in a way such that the legs 20, 21 of each post 10 are aligned with the legs 20, 21 of the remaining 3 posts to form a rectangular shape within the legs 20, 21 of all four posts 10. The structural beams 2, 25, or 30 can then be removeably attached to the vertical posts 10 such as seen in FIG. 4 or FIG. 10. In operation, the nubs 14 are inserted through respective key shaped apertures 18 such that the nub head 15 of the nub 14 passes through the circular hole 19 as shown in FIG. 4 and FIG. 10. To removeably lock the beams 2, 25, or 30 to the vertical posts 10, the structural beams 2, 25, 30 and the nubs 14 should be adjusted downward so that the nub neck 15*a* becomes positioned in the slots 19*a* as seen in FIG. 6 and FIG. 12. The shape of the circular hole 19 corresponds to that of the nub head 15 and the width of the slot 19*a* corresponds to that of the nub neck 15*a*. The structural beams 2, 25, or 30 are secured to the posts 10 using this method due to the tight fit created between the nub neck 15*a* and the slots 19*a* combined with the weight of said beams 2, 25, or 30 in conjunction with gravity to hold said beams 2, 25, or 30 in place. This process should be repeated until all structural beams 2, 25, or 30 are removeably attached to the vertical posts 10.

Once structural beams 2, 25, or 30 are associated to vertical post 10, it is then possible to removeably associate shelf member 12 to the unit thereby completing the shelving unit 1. To associate with the recessed structural beams 2 or 30, shelving members 12 are positioned to rest on the recessed flange base 7 or 33 of recessed flanges 6 or 31 of the recessed structural beams 2 or 30, respectively, as seen with recessed structural beams 2 in FIG. 6. To associate with the standard structural beams 25, shelving members 12 are positioned to rest on top of angled standard flange 27 as seen in FIG. 12. The shelving member 12 is secured due to the weight of the shelving member 12 in conjunction with gravity.

Figure 3:
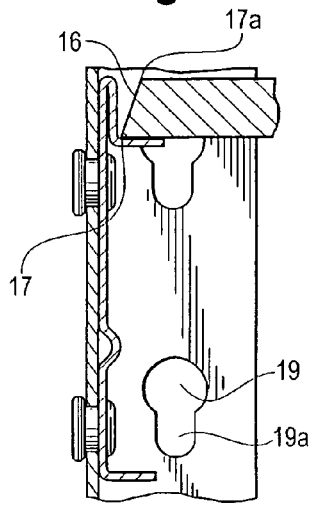
FIG. 3 is a broken view illustrating the connection between the shelving member and the structural beam via the recessed flange.

The shelving members 12 can include particle board, wood board, plywood, or any similar material. The shelving members 12 generally have a rectangular shape as seen in FIG. 1. The shelving members 12 contain a taper 16 as seen in FIG. 3 to provide clearance for various attachments when used with recessed structural beams 2 or 30. The taper 16 is such that the distance from the end of the shelving member base 17 to the vertical centerline of the shelving member is greater than the distance from the end of the shelving member top 17*a* to the vertical centerline of the shelving member. This is true for all 4 sides of the shelving member 12.

Figure 9:
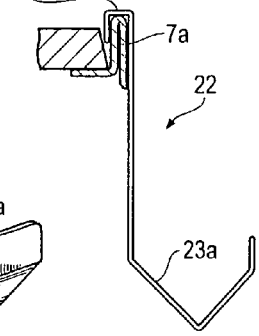
FIG. 9 is the side view of the example profile for the attachment shown in FIG. 8.
Figure 8:
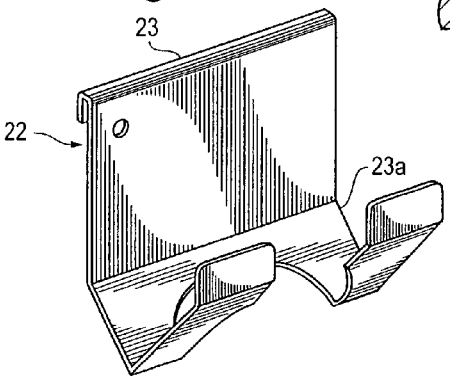
FIG. 8 is a pictorial view of an example of one profile possible with an attachment.

Various attachments such as the one pictured in FIG. 8 and FIG. 9 will fit securely on the recessed flange side 7*a*. The clearance provided between the shelving member top 1 7*a* and the recessed flange side 7*a*, enable the attachment 22 to become removably attached to the shelving unit 1 via the recessed flange side 7*a*. The upper hook 23 of the attachment 22 is of a shape which corresponds to thickness of the recessed flange side 7*a* such that the upper hook 23 securely fastens to said recessed flange side 7*a* thereby creating a tight fit as seen in FIG. 9. Although the upper hook 23 of the attachment 22 must remain constant in size and shape, the base 23*a* of the attachment 22 may be varied to hold different objects such as hammers or brooms.

It may thus be seen that the objects of the present inventions set forth as well as those made apparent from the foregoing description, are officially obtained. While the preferred embodiments of the invention have been set for purposes of disclosure, modification of the disclosed embodiments of the invention as well as other embodiments thereof may occur to those skilled in the art. Accordingly, the appended claims are intended to cover all embodiments which do not depart from the spirit and scope of the invention.

We claim:

1. A framework that can be used for storage comprising:

recessed structural beams having a return flange at their base, a vertically recessed flange at their top, and a rib there between, said recessed structural beams being positioned horizontally and parallel with the ground to define parallelograms there between, at least four parallel vertical posts, each extending at a right angle to said recessed structural beams and being positioned at each of the corners of the parallelogram formed by said recessed structural beams, at least two shelf members shaped substantially in the form of said parallelograms formed by said recessed structural beams, said recessed structural beams being removeably associated to vertical posts to form four corners, thereby enabling said shelf members to be supported by said recessed structural beams and removeably secured by said recessed flanges of said recessed structural beams.

2. A framework as defined in claim 1 wherein said recessed structural beams include:

said horizontal return flange on the base of each of said recessed structural beams extending the full length of said recessed structural beams.

3. A framework as defined in claim 1 wherein said recessed structural beams include:

said recessed flange at top of said recessed structural beams taking the form of an "L" shape where the base of said "L" is parallel to the horizontal return flange located at the base of said recessed structural beams, the recessed flange being chamfered at both ends of said recessed structural beams enabling said recessed structural beams to create a corner fit.

4. A framework as defined in claim 1 wherein said recessed structural beams include:

said rib strategically positioned between said recessed structural beams' base and top, which extends the full length of said recessed structural beams.

5. A framework as defined in claim 1 wherein said recessed structural beams include:

a variable number of mushroom shaped nubs attached to the ends of said recessed structural beams proportionately located near the base and top in a combination that will enable the assembly of said recessed structural beams to said vertical posts.

6. A framework as defined in claim 1 wherein said shelf member contains a slight taper from the base to the top of said shelf member so that the distance from the end of the shelf member base to the vertical centerline of the shelf member is greater than the distance from the end of the shelf member top to the vertical centerline of the shelf member, said taper allows clearance for various attachments.

7. A framework as defined in claim 1 wherein said vertical posts encompass two perpendicular planes which meet at a right angle, said posts are orientated to create a corner open to said recessed structural beams, and each plane of said vertical posts contain key shaped apertures spaced from the top of said vertical posts to the base of said vertical posts enabling said vertical posts to fasten to said recessed structural beams.

8. A framework according to claim 1 which is assembled by way of:

orientating the "L" shaped recessed flange on each of said recessed structural beams toward the center of the parallelogram created by said four recessed structural beams, aligning said nubs on each of said recessed structural beams with said key hole shaped apertures on vertical posts, inserting said nubs into the largest diameter portion of said apertures of said vertical posts which enables the nubs to securely fasten said recessed structural beams to said vertical posts by dropping vertically towards the smaller diameter portion of the aperture thereby creating a tight fit, this insertion of said nubs with said apertures is executed at both ends of said recessed structural beams with corresponding vertical posts, said shelf member is removeably secured to recessed structural beams by resting on said recessed flanges of each of four said recessed structural beams, which combines with said taper allowing slight clearance at the top of said shelf member for various attachments.

9. An attachment for use with the framework described in claim 1 including:

an upper hook enabling the attachment to be removeably attached to the recessed flange, namely the vertical portion of the "L" shaped recessed flange on the recessed structural beam, via the taper created in the shelf member as described in claim 6.

10. A framework that can be used for storage comprising:

recessed structural beams having a return flange at their base and a vertically recessed flange at their top, said recessed structural beams being positioned horizontally and parallel with the ground to define parallelograms there between, at least four parallel vertical posts, each extending at a right angle to said recessed structural beams and being positioned at each of the corners of the parallelogram formed by said recessed structural beams, at least two shelf members shaped substantially in the form of said parallelograms formed by said recessed structural beams, said recessed structural beams being removeably associated to vertical posts to form four corners, thereby enabling said shelf members to be supported by said recessed structural beams and removeably secured by said recessed flanges of said recessed structural beams.

11. A framework as defined in claim 10 wherein said recessed structural beams include:

said horizontal return flange on the base of each of said recessed structural beams extending the full length of said recessed structural beam.

12. A framework as defined in claim 10 wherein said recessed structural beams include:

said recessed flange at top of said recessed structural beams taking the form of an "L" shape where the base of said "L" is parallel to the horizontal return flange located at the base of said recessed structural beams, the recessed flange being chamfered at both ends of said recessed structural beams enabling said recessed structural beams to create a corner fit.

13. A framework as defined in claim 10 wherein said recessed structural beams include:

a variable number of mushroom shaped nubs attached to the ends of said recessed structural beams proportionately located near the base and top in a combination that will enable the assembly of said recessed structural beams to said vertical posts.

14. A framework as defined in claim 10 wherein said shelf member contains a slight taper from the base to the top of said shelf member so that the distance from the end of the shelf member base to the vertical centerline of the shelf member is greater than the distance from the end of the shelf member top to the vertical centerline of the shelf member, said taper allows clearance for various attachments when associated with recessed structural beam.

15. A framework as defined in claim 10 wherein said vertical posts encompass two perpendicular planes which meet at a right angle, said posts are orientated to create a corner open to said recessed structural beams, and each plane of said vertical posts contain key shaped apertures spaced from the top of said vertical posts to the base of said vertical posts enabling said vertical posts to fasten to said recessed structural beams.

16. A framework according to claim 10 which is assembled by way of:

orientating the "L" shaped recessed flange on each of said recessed structural beams toward the center of the parallelogram created by said four recessed structural beams, aligning said nubs on each of said recessed structural beams with said key hole shaped apertures on vertical posts, inserting said nubs into the largest diameter portion of said apertures of said vertical posts which enables the nubs to securely fasten said recessed structural beams to said vertical posts by dropping vertically towards the smaller diameter portion of the aperture thereby creating a tight fit, this insertion of said nubs with said apertures is executed at both ends of said recessed structural beams with corresponding vertical posts, said shelf member is removeably secured to recessed structural beams by resting on said recessed flanges of each of four said recessed structural beams, which combines with said taper allowing slight clearance at the top of said shelf member for various attachments.

17. An attachment for use with the framework described in claim 10 including:

an upper hook enabling the attachment to be removeably attached to the recessed flange, namely the vertical portion of the "L" shaped recessed flange on the recessed structural beam, via the taper created in the shelf member as described in claim 14.

18. A framework that can be used for storage comprising:

standard structural beams having an angled return flange at their base, an vertically angled standard flange at their top, and a rib there between, said standard structural beams being positioned horizontally and parallel with the ground to define parallelograms there between, at least four parallel vertical posts, each extending at a right angle to said standard structural beams and being positioned at each of the corners of the parallelogram formed by said standard structural beams, at least two shelf members shaped substantially in the form of said parallelograms formed by said standard structural beams, said standard structural beams being removeably associated to vertical posts to form four corners, thereby enabling said shelf members to be supported by said standard structural beams and removeably secured by said standard angled flanges of said standard structural beams.

19. A framework as defined in claim 18 wherein said standard structural beams include:

said rib strategically positioned between said standard structural beams' base and top, which extends the full length of said standard structural beams.

20. A framework as defined in claim 18 wherein said standard structural beams include:

said angled return flange so that the beams contain an acute angle of approximately 85 degrees on the base of each of said standard structural beams extending the full length of said standard structural beams.

21. A framework as defined in claim 18 wherein said standard structural beams include:

said standard angled flange at top of said standard structural beams so that the beams contain an acute angle of approximately 85 at the top of each said standard structural beams extending the full length of said standard structural beams.

22. A framework as defined in claim 18 wherein said standard structural beams include:

a variable number of mushroom shaped nubs attached to the ends of said standard structural beams proportionately located near the base and top in a combination that will enable the assembly of said standard structural beams to said vertical posts.

23. A framework as defined in claim 18 wherein said vertical posts encompass two perpendicular planes which meet at a right angle, said posts are orientated to create a corner open to said standard structural beams, and each plane of said vertical posts contain key shaped apertures spaced from the top of said vertical posts to the base of said vertical posts enabling said vertical posts to fasten to said standard structural beams.

24. A framework according to claim 18 which is assembled by way of:

orientating the standard structural beams so that the flanges are directed toward the center of the parallelogram created by said four standard structural beams, aligning said nubs on each of said standard structural beams with said key hole shaped apertures on vertical posts, inserting said nubs into the largest diameter portion of said apertures of said vertical posts which enables the nubs to securely fasten said standard structural beams to said vertical posts by dropping vertically towards the smaller diameter portion of the aperture thereby creating a tight fit, this insertion of said nubs with said apertures is executed at both ends of said standard structural beams with corresponding vertical posts, said shelf member is removeably secured to standard structural beams by resting on said standard angled flange of each of four said standard structural beams.

25. A recessed structural beam for use with a storage unit comprising:

a horizontal return flange on the base of said recessed structural beam extending the full length of said recessed structural beam, a rib strategically positioned between said recessed structural beam's base and top, which extends the full length of said recessed structural beam, a vertically recessed flange at top of said recessed structural beam taking the form of "L" shape where the base of said "L" is parallel to the horizontal return flange located at the base of said recessed structural beam, the recessed flange is chamfered at both ends of said recessed structural beam enabling said recessed structural beams to create a corner fit, a variable number of mushroom shaped nubs attached to the ends of said recessed structural beam proportionately located near the base and top in a combination that will enable the assembly of said recessed structural beam to said vertical posts.

* * * * *